United States Patent [19]

Shimizu

[11] Patent Number: 4,949,547

[45] Date of Patent: Aug. 21, 1990

[54] METHOD OF AND APPARATUS FOR AIR-CONDITIONING INDIVIDUAL SPACES

[75] Inventor: Hiroyuki Shimizu, Hamamatsu, Japan

[73] Assignee: Yazaki Corporation, Tokyo, Japan

[21] Appl. No.: 302,932

[22] Filed: Jan. 30, 1989

[30] Foreign Application Priority Data

Feb. 1, 1988 [JP] Japan ..... 63-21666

[51] Int. Cl.[5] ..... F25B 7/00

[52] U.S. Cl. ..... 62/79; 62/238.7; 62/324.1; 62/335

[58] Field of Search ..... 62/324.1, 238.7, 335, 62/238.6, 183, 305, 506

[56] References Cited

U.S. PATENT DOCUMENTS

| | | | |
|---|---|---|---|
| 3,789,621 | 2/1974 | Inuzuka | 62/324.1 |
| 4,024,728 | 5/1977 | Gustafsson | 62/324.1 X |
| 4,104,890 | 8/1978 | Iwasaki | 62/335 X |
| 4,522,253 | 6/1985 | Levin | 62/324.1 X |
| 4,653,287 | 3/1987 | Martin, Jr. | 62/238.7 X |
| 4,745,770 | 5/1988 | Mintz | 62/324.1 X |

*Primary Examiner*—Lloyd L. King

*Attorney, Agent, or Firm*—Venable, Baetjer and Howard

[57] ABSTRACT

A central heat source system is used as the method of air-conditioning individual spaces, and warm water in the range of 15° to 25° C. is produced by a warm water generator having a heating device and a cooling device. The warm water is circulated among the warm water generator and a plurality of heat pumps connected thereto. In a certain room, the heat pump can be operated to perform cooling by using the warm water as cooling water, while in another room the heat pump can be operated to perform heating by using the warm water as heat source water. In addition, when the heated warm water used for cooling and the cooled warm water used for heating are returned to the warm water generator and are mixed therein, the thermal energy gained or lost by the respective warm water can be offset with each other, so that it is possible to reduce the amount of energy necessary for maintaining the warm water at 15° to 25° C., thereby making it possible to effect energy-saving in air-conditioning.

20 Claims, 2 Drawing Sheets

METHOD OF AND APPARATUS FOR AIR-CONDITIONING INDIVIDUAL SPACES

BACKGROUND OF THE INVENTION:

Field of the Invention:

The present invention relates to a method of and an apparatus for air-conditioning individual spaces in a central heat source system for cooling or heating individual spaces by means of air-conditioners respectively disposed therein.

Description of the Prior Art:

As one method of air-conditioning using a conventional central heat source system, a method of air-conditioning such as the one shown in FIG. 3 is known. In the drawing, in a cold and hot water generator 5, approx. 7°C. cold water is created as a heat medium at the time of cooling, and 50 -60°C. warm water is created at the time of heating. Such water is supplied to individual rooms which constitute spaces to be air-conditioned, by means of a pump 6 via the piping 7. Air-conditioners 8A, 8B, 8C, and 8D, which are formed as heat exchangers and serve as room units, at least one for each room, are installed in the respective rooms. The room temperature is controlled by effecting cooling by using cold water supplied through the piping 7 or heating by using warm water supplied through the piping 7. Subsequently, cold water used in cooling is warmed, or warm water used in heating is cooled and returned to the cold and warm water generator 5, where the temperature of the water is controlled again to a predetermined level.

In such a conventional method of air-conditioning based on the central heat source system, the cold and warm water generator 5 is capable of generating either one of approx. 7–C. cold water or 50–60°C. warm water at a time. Therefore, if, for instance, cooling and heating are required simultaneously for the space in which the room unit 8A is installed and for the space in which the room unit 8B is installed, respectively, it has not been possible to meet the requirements simultaneously. However, in the case of air-conditioning a building, there are cases where cooling is required for a sunny zone which faces the south, while heating is required in a zone which faces the north and does not admit much sunshine. In addition, in an electronic computer room, there are cases where cooling is required even during the winter season since the amount of heat generated therein is large. Thus, in recent years there has been an increasing number of cases where cooling and heating are required simultaneously within the same building. With respect to the form of air-conditioning load in which cooling and heating are required simultaneously for a certain zone and for another zone, respectively, the above-described conventional method of air-conditioning based on the central heat source system has had the problem that it cannot cope since the cold and warm water generator is able to produce either cold water or warm water at a time. In addition, it has been necessary to adopt an individual air-conditioning system in which independent air-conditioners are arranged in individual spaces to be air-conditioned. In the case of this individual air-conditioning system, since a heat source is provided for each air-conditioner, there has been the problem that the equipment costs become high and the loss of thermal energy is large.

SUMMARY OF THE INVENTION:

Accordingly, an object of the present invention is to provide a method of and an apparatus for air-conditioning individual spaces in the central heat source system which is capable of coping with cooling and heating loads required simultaneously, and of alleviating the amount of energy consumed for those cooling and warming loads, thereby overcoming the above-described drawbacks of the conventional art.

To this end, in accordance with one aspect of the present invention, there is provided a method of air-conditioning individual spaces, comprising the steps of: producing warm water in a temperature range of 15 to 25°C. by a warm water generator having heating means and cooling means; circulating the warm water among a plurality of heat pumps and the warm water generator; and operating a heat pump concerned to perform a cooling operation by using the warm water as cooling water in a space where a cooling load is required, while operating the heat pump concerned to perform a heating operation by using the warm water as heat source water in a space where a heating load is required.

In accordance with another aspect of the present invention, there is provided an air-conditioner for individual spaces, comprising: a warm water generator having heating means and cooling means and adapted to produce warm water in a temperature range of 15 to 25°C.; a cooling heat pump which causes a refrigerant contained therein to act in the cycle of compression, condensation, expansion and evaporation and which, in the condenser, uses as cooling water the warm water supplied from the warm water generator; a heating heat pump which causes a refrigerant contained therein to act in the cycle of compression, condensation, expansion and evaporation and which, in the evaporator, uses as heat source water the warm water supplied from the warm water generator; and a pump for circulating the warm water among the warm water generator, the cooling heat pump, and the heating heat pump that are connected in parallel to each other.

In accordance with a method of and an apparatus for air-conditioning individual spaces on the basis of the present invention, since a plurality of heat pumps which operate as heaters or coolers by means of 15–25°C. warm water generated by a warm water generator are respectively arranged at a plurality of places, it is possible to effect cooling in certain places and heating in other places arbitrarily on the basis of the user's requirements.

In addition, the warm water used for cooling in some places is heated, and the warm water used for heating in other places is cooled, and is returned to the warm water generator. Since the heated warm water and the cooled warm water are mixed together, their respective energy gained and lost can be offset with each other, so that the temperature of the warm water becomes moderate. Accordingly, it is possible to reduce the amount of energy required in maintaining the returned warm water at 15 -25°C., thereby making it possible to effect energy-consumption of the air-conditioner.

DETAILED DESCRIPTION OF THE PREFERRED EMBODIMENTS

Figure 1:
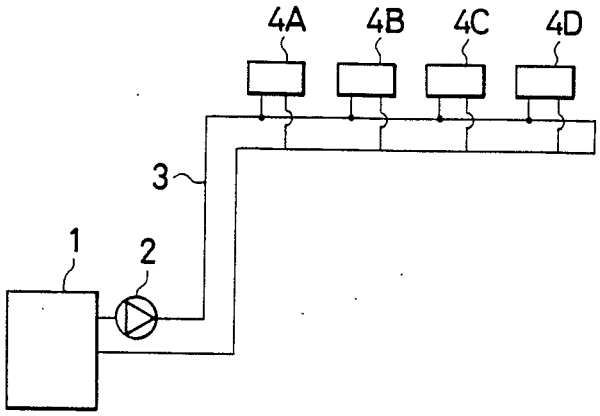
FIG. 1 is a diagram illustrating an embodiment of a method of air-conditioning individual spaces in a central heat source system in accordance with the present invention.
Figure 3:
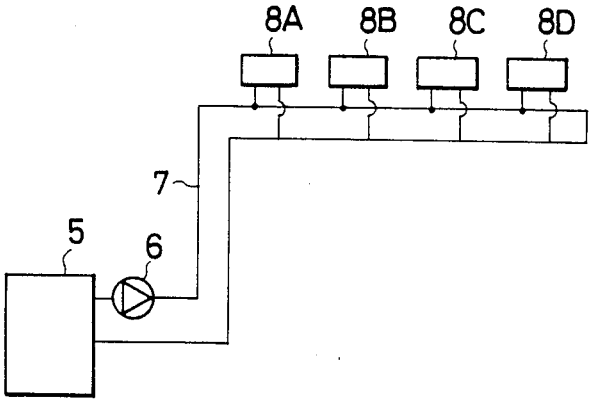
FIG. 3 PRIOR ART
FIG. 3 is a diagram illustrating a conventional method of air-conditioning in the central heat source system.
Figure 2:
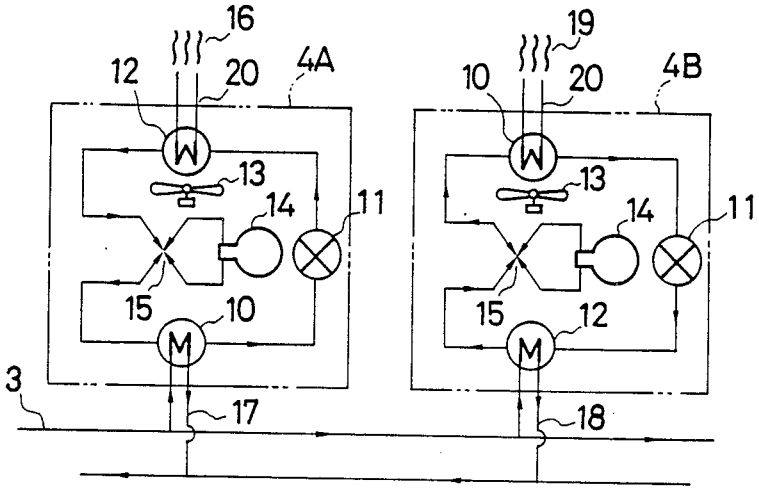
FIG. 2 is a diagram explaining a combination of a heat pump for effecting a cooling operation and a heat pump for effecting a heating operation.

Referring now to FIGS. 1 and 2, a description will be given of an embodiment of a method of air-conditioning individual spaces in accordance with the present invention.

Warm water of about 15–25°C. is generated by a warm water generator 1 throughout the year, and this warm water is supplied to electrical heat pumps 4A–4D for air-conditioning arranged at a plurality of places, by a pump 2 via the piping 3. After cooling and heating are carried out, the warm water is returned to the warm water generator 1 and is recirculated. For instance, if cooling is required for the space where the heat pump 4A is installed, the heat pump 4A performs a cooling operation by using the warm water as cooling water. If heating is required simultaneously for the space where the heat pump 4B is installed, the heat pump 4B carries out a heating operation by using the warm water as heating water.

A brief description will now be given of the mechanism of the heat pump. The operation of the heat pump can be classified into the following four processes:

Compression process: The steam of a low-temperature, low-pressure refrigerant which has evaporated is compressed by a compressor to form high-temperature, high-pressure refrigerant steam.

Condensation process: The compressed high-temperature, high-pressure steam of the refrigerant is cooled by a condenser by using, for instance, water, so as to be condensed into a refrigerant liquid. The water deprives the refrigerant steam of heat, and its temperature rises as a result.

Expansion process: The condensed refrigerant liquid is subjected to heat insulation and expansion by an expansion valve so as to be formed into a mist-like refrigerant.

Evaporation process: The mist-like refrigerant deprives a medium to be cooled in an evaporator, such as water, of heat so as to be formed into refrigerant steam, and the temperature of the water declines as a result.

The heat pump functions as a heater if the water whose temperature has become high after depriving the refrigerant steam in the condensation process is used, and also functions as a cooler if the water which has been cooled by being deprived of its heat by the wet steam of the refrigerant in the evaporation process.

In FIG. 2, the following operation takes place in the heat pump 4A which performs a cooling. A refrigerant which is a working fluid for the heat pump is cooled by a condenser 10 by means of warm water supplied through the piping 3 and is converted from high-temperature, high-pressure refrigerant steam into a refrigerant liquid. This refrigerant liquid is subjected to heat insulation and expansion by an expansion valve 11, is thereby converted into a mist-like refrigerant, and is sent to an evaporator. The mist-like refrigerant deprives air sucked toward the periphery of the evaporator 12 by a fan 13 of its heat and is thereby converted into refrigerant steam. This refrigerant steam is compressed to high temperature and high pressure by a compressor 14, and is returned to the condenser 10 via a changeover valve 15. Meanwhile, the air 16 which has been cooled by being deprived of its heat is sent out by the fan 13 and is used to cool the room. In addition, this cooled air 16 can be used for refrigeration as well. Then, the warm water is heated by the heat of the refrigerant steam in the condenser 10, is thereby converted into warm water 17, and is then returned to the warm water generator 1.

The heat pump 4B which performs a heating operation is structurally the same as the heat pump 4A which performs a cooling operation. This is because since the condenser and the evaporator of the heat pump are functionally interchangeable, if the direction of flow of the medium in the heat pump is reversed, the heat pump can be used for both cooling and heating. In addition, the refrigerant operates always after undergoing the processes of evaporation, compression, condensation, and expansion.

In the heat pump 4B which performs a heating operation, the warm water supplied from the warm water generator 1 is used as a heat source for converting the mist-like refrigerant into refrigerant steam by the evaporator 12. As a result, the warm water is thus cooled and converted into cooling water 18, and is then returned to the warm water generator 1. In addition, the condenser 10 is cooled by the air sucked by the fan 13, while air 19 which has deprived the condenser 10 of its heat is sent out by the fan 13 and is used for heating the room. Furthermore, if a coil 20 is provided in the condenser 10 instead of sending the air, and water is supplied to that coil 20, water is heated inside the condenser 10, so that it is possible to obtain hot water.

Accordingly, in accordance with the method of air-conditioning individual spaces by means of heat pumps as in the case of this embodiment, it is possible to effect a cooling or heating operation in correspondence with the requirement of each space to be air-conditioned on the basis of the central heat source system. Furthermore, as described above, if the heat pump 4A is used for a cooling operation, the heat pump 4A heats the warm water, while if the heat pump 4B is used for a heating operation, the heat pump 4B cools the warm water. Accordingly, if the heat pumps 4A and 4B are operated in the different modes of cooling and heating, the heated warm water and the cooled warm water converge and return to the warm water generator 1, and since the thermal energy obtained by the heated warm water is offset with the thermal energy lost by the cooled warm water to average the temperature of the warm water, it is possible to reduce the amount of energy necessary for maintaining the predetermined temperature of the warm water in this warm water generator 1, as compared with the individual air-conditioning system described in the section on the related art.

Although in the foregoing description the heat pump 4 is used for cooling and heating, if the heat pumps are used also for such as a hot water supplier using 15–25°C. warm water as a heat source and a showcase refrigerator using 15–25°C. warm water as cooling water, it is possible to offset the energy obtained in cooling and refrigeration with the energy lost in heating and hot water supply, thereby making it possible to alleviate the heating load on the warm water generator. In short, it is possible to realize an energy-saving system. If an absorption-type cold and hot water supplier which uses a gas, kerosene, heavy oil, or the like as a driving heat source is employed as the warm water generator instead of an electrical compression-type warm water generator, it is possible to reduce the amount of power consumption of the overall system of the cooling and heating apparatus by ½to ¼as compared with the electrical compression-type warm water generator, so thereby contributing to alleviation of the power requirements during summer.

Furthermore, with respect to the heat pump, although it is conceivable to adopt a heat pump using the air as a heat source, the drawback of the heat pump using the air as the heat source is that since it is impossible to provide sufficient heating when the temperature of the atmosphere has declined during winter, this heat pump often imparts discomfort to the user. On the other hand, with the heat pump using the warm water as a heat source in accordance with this embodiment, it is possible to effect a sufficient heating operation even during winter.

It should be noted that, if the temperature of the warm water produced in the warm water generator is set to about 15–25°C., the effect of the atmospheric temperature can be minimized throughout the year, and it is easy to maintain the temperature of the warm water. As for this warm water, it is conceivable to set its temperature close to 15°C. during summer since cooling is primarily effected and close to 25°C. during winter since heating is primarily effected.

What is claimed is:

1. A method for air-conditioning a plurality of individual spaces, comprising the following steps:

producing warm water within a predetermined temperature range by means of a warm water generator, said warm water generator having means for heating and means for cooling;

circulating said warm water among a plurality of heat pumps, which are connected in parallel, and said warm water generator, one of said plurality of heat pumps being arranged in each of said plurality of individual spaces; and operating a first of said heat pumps to perform a cooling operation for the individual space in which said first heat pump is arranged by using said warm water as a source of cooling water, while operating a second of said heat pumps to perform a heating operation for the individual space in which said second heat pump is arranged by using said warm water as a source of heating water.

2. A method for air-conditioning individual spaces according to claim 1, further comprising the step of operating said first heat pump to perform a refrigerating operation for preserving goods in the individual space in which said first heat pump is arranged by using said warm water as a source of cooling water.

3. A method for air-conditioning individual spaces according to claim 1, further comprising the step of operating said first heat pump to perform a freezing operation for preserving goods in the individual space in which said first heat pump is arranged by using said warm water as a source of cooling water.

4. A method for air-conditioning individual spaces according to claim 1, further comprising the step of operating said second heat pump to perform a hot-water supplying operation for the individual space in which said second heat pump is arranged by using said warm water as a source of heating water.

5. A method for air-conditioning a plurality of individual spaces, comprising the following steps:

producing warm water in a temperature range of 15 to 25°C. by means of a warm water generator, said warm water generator having means for heating and means for cooling;

circulating said warm water among a plurality of heat pumps, which are connected in parallel, and said warm water generator, one of said plurality of heat pumps being arranged in each of said plurality of individual spaces; and operating a first of said heat pumps to perform a cooling operation for the individual space in which said first heat pump is arranged by using said warm water as a source of cooling water, while operating a second of said heat pumps to perform a heating operation for the individual space in which said second heat pump is arranged by using said warm water as a source of heating water.

6. A method for air-conditioning individual spaces according to claim 5, further comprising the step of operating said first heat pump to perform a refrigerating operation for preserving goods in the individual space in which said first heat pump is arranged by using said warm water as a source of cooling water.

7. A method for air-conditioning individual spaces according to claim 5, further comprising the step of operating said first heat pump to perform a freezing operation for preserving goods in the individual space in which said first heat pump is arranged by using said warm water as a source of cooling water.

8. A method for air-conditioning individual spaces according to claim 5, further comprising the step of operating said second heat pump to perform a hot-water supplying operation for the individual space in which said second heat pump is arranged by using said warm water as a source of heating water.

9. A method for air-conditioning individual spaces according to claim 6, further comprising the step of operating said second heat pump to perform a hot-water supplying operation for the individual space in which said second heat pump is arranged by using said warm water as a source of heating water.

10. A method for air-conditioning individual spaces according to claim 7, further comprising the step of operating said second heat pump to perform a hot-water supplying operation for the individual space in which said second heat pump is arranged by using said warm water as a source of heating water.

11. A system for air-conditioning a plurality of individual spaces, comprising:

a warm water generator for producing warm water in a predetermined temperature range, said warm water generator having means for heating and means for cooling;

a first heat pump comprising a compressor, a condenser, an expander, and an evaporator, said first heat pump adapted to have a refrigerant flow through said compressor, condenser, expander, and evaporator, said condenser using said warm water as a source of cooling water;

a second heat pump comprising a compressor, a condenser, an expander, and an evaporator, said second heat pump adapted to have a refrigerant flow through said compressor, condenser, expander, and evaporator, said evaporator using said warm water as a source of heating water; and a pump for circulating said warm water among said warm water generator, said first heat pump, and said second heat pump, said first heat pump and said second heat pump being connected in parallel.

12. A system for air-conditioning individual spaces according to claim 11, wherein said condenser and evaporator of said first heat pump are mechanically interchangeable and said condenser and evaporator of said second heat pump are mechanically interchangeable, such that said first heat pump can provide a heating operation and said second heat pump can provide a cooling operation.

13. A system for air-conditioning individual spaces according to claim 11, wherein said first heat pump and said second heat pump are each provided with a changeover valve for reversing the direction of flow of refrigerant from the compressor, such that said first heat pump can provide a heating operation and said second heat pump can provide a cooling operation.

14. A system for air-conditioning a plurality of individual spaces according to claim 12, wherein said condenser of said first heat pump and said condenser of said second heat pump are each provided with a coil pipe adapted to have a supply of water flow therethrough, such that said coil pipe acts as a heat exchanger for heating said supply of water when said first heat pump or said second heat pump is used for a heating operation.

15. A system for air-conditioning a plurality of individual spaces according to claim 11, wherein said second heat pump is provided with a coil pipe adapted to have a supply of water flow therethrough, such that said coil pipe acts as a heat exchanger for heating said supply of water.

16. A system for air-conditioning a plurality of individual spaces, comprising:

a warm water generator for producing warm water in a temperature range of 15 to 25° C., said warm water generator having means for heating and means for cooling;

a first heat pump comprising a compressor, a condenser, an expander, and an evaporator, said first heat pump adapted to have a refrigerant flow through said compressor, condenser, expander, and evaporator, said condenser using said warm water as a source of cooling water;

a second heat pump comprising a compressor, a condenser, an expander, and an evaporator, said second heat pump adapted to have a refrigerant flow through said compressor, condenser, expander, and evaporator, said evaporator using said warm water as a source of heating water; and a pump for circulating said warm water among said warm water generator, said first heat pump, and said second heat pump, said first heat pump and said second heat pump being connected in parallel.

17. A system for air-conditioning individual spaces according to claim 16, wherein said condenser and evaporator of said first heat pump are mechanically interchangeable and said condenser and evaporator of said second heat pump are mechanically interchangeable, such that said first heat pump can provide a heating operation and said second heat pump can provide a cooling operation.

18. A system for air-conditioning individual spaces according to claim 16, wherein said first heat pump and said second heat pump are each provided with a changeover valve for reversing the direction of flow of refrigerant from the compressor, such that said first heat pump can provide a heating operation and said second heat pump can provide a cooling operation.

19. A system for air-conditioning individual spaces according to claim 17, wherein said condenser of said first heat pump and said condenser of said second heat pump are each provided with a coil pipe adapted to have a supply of water flow therethrough, such that said coil pipe acts as a heat exchanger for heating said supply of water when said first heat pump or said second heat pump is used for a heating operation.

20. A system for air-conditioning individual spaces according to claim 16, wherein said second heat pump is provided with a coil pipe adapted to have a supply of water flow therethrough, such that said coil pipe acts as a heat exchanger for heating said supply of water.

* * * * *